US006573922B1

(12) United States Patent
Orita et al.

(10) Patent No.: US 6,573,922 B1
(45) Date of Patent: Jun. 3, 2003

(54) THERMAL HEAD DRIVER SYSTEM AND THERMAL IMAGE-FORMING APPARATUS THEREWITH

(75) Inventors: Hiroshi Orita, Saitama (JP); Minoru Suzuki, Tochigi (JP); Hiroyuki Saito, Saitama (JP); Katsuyoshi Suzuki, Tokyo (JP); Koichi Furusawa, Tokyo (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/292,831

(22) Filed: Apr. 16, 1999

(30) Foreign Application Priority Data

Apr. 16, 1998 (JP) ..... 10-106137

(51) Int. Cl.[7] ..... B41J 2/36; B41J 2/355

(52) U.S. Cl. ..... 347/191

(58) Field of Search ..... 347/171, 191, 347/172, 173; 400/120.01; 846/76.1; B41J 2/32, 2/325

(56) References Cited

U.S. PATENT DOCUMENTS

| | | | | |
|---|---|---|---|---|
| 4,399,209 A | | 8/1983 | Sanders et al. | |
| 4,440,846 A | | 4/1984 | Sanders et al. | |
| 4,644,376 A | | 2/1987 | Usami et al. | |
| 4,833,488 A | * | 5/1989 | Mizutani et al. | 346/46 |
| 5,015,552 A | * | 5/1991 | Tamura et al. | 347/172 |
| 5,104,767 A | | 4/1992 | Nakamura | 430/138 |
| 5,729,274 A | * | 3/1998 | Sato | 347/173 |
| 5,825,985 A | | 10/1998 | Asai et al. | |

FOREIGN PATENT DOCUMENTS

| | | |
|---|---|---|
| JP | 61137787 | 6/1986 |
| JP | 4-4960 | 1/1992 |

* cited by examiner

*Primary Examiner*—John Barlow
*Assistant Examiner*—K. Feggins
(74) *Attorney, Agent, or Firm*—Greenblum & Bernstein, P.L.C.

(57) ABSTRACT

A thermal head driver system cyclically and independently drives at least two thermal heads having each a plurality of electric resistance elements. A storage system cyclically stores an image information data, the image information data cyclically being each of at least two types of image information data, respectively corresponding to the thermal heads. A selector system cyclically and correspondingly selects which thermal head should be driven in accordance with the cyclical storage of the types of image information data in the storage system, such that the electric resistance elements of the thermal head, selected by the selector system, are selectively and electrically energized in accordance with a corresponding type of image information data cyclically stored in the storage system.

17 Claims, 11 Drawing Sheets

FIG. 10

TABLE

| ST1 | ST2 | OUTPUT LEVEL OF A/G 56C | OUTPUT LEVEL OF A/G 56M | OUTPUT LEVEL OF A/G 56Y |
|---|---|---|---|---|
| L | L | L | L | L |
| H | L | L | H | L |
| L | H | H | L | L |
| H | H | L | L | H |

THERMAL HEAD DRIVER SYSTEM AND THERMAL IMAGE-FORMING APPARATUS THEREWITH

BACKGROUND OF THE INVENTION

1. Field of the Invention

The present invention relates to a thermal head driver system for electrically driving a thermal head, and also relates to an image-forming apparatus having such a thermal head and such a thermal head driver incorporated therein.

2. Description of the Related Art

A thermal head driver system for electrically driving a thermal head is well known. For example, the thermal head is arranged as a line type of thermal head having a plurality of electric resistance elements aligned with each other, and the thermal head driver system is constituted such that the electric resistance elements are selectively and electrically energized in accordance with a single-line of digital image-pixel signals, thereby producing an image on, for example, a thermal sensitive recording sheet.

Usually, the thermal head driver system includes a shift register, and a latch circuit connected in parallel to the shift register. The single-line of digital image-pixel signals is serially inputted to and is temporarily stored in the shift register, and the stored digital image-pixel signals are then shifted to the latch circuit. The shifted digital image-pixel signals are latched by the latch circuit, and are stably held therein. The latch circuit is provided with a plurality of output terminals corresponding to a number of the digital image-pixel signals held therein, and each of the output terminals outputs a high-level signal only when a corresponding digital image-pixel signal has a value "1".

The thermal head driver system also includes a plurality of AND-gate circuits each having two input terminals and an output terminal, and a plurality of switching circuits associated with the AND-gate circuits, respectively. One of the input terminals of each AND-gate circuit is connected to a corresponding one of the output terminals of the latch circuit, and the other input terminal of each AND-gate circuit is wired so as to receive a strobe signal having a predetermined pulse width. The output terminal of each AND-gate circuit is connected to the switching circuit associated therewith. Each of the electric resistance elements of the line thermal head is connected to an electric power source through a corresponding switching circuit.

With this arrangement of the thermal head driver system, when one of the digital image-pixel signals held in the latch circuit has a value "1", so that a high-level signal is outputted from a corresponding output terminal of the latch circuit, a corresponding AND-gate circuit is opened so that a corresponding switching circuit is turned ON, whereby a corresponding electric resistance element is electrically energized over a period corresponding to the pulse width of the strobe signal so as to be heated to a predetermined temperature. On the other hand, when one of the digital image-pixel signals held in the latch circuit has a value "0", a corresponding AND-gate circuit is maintained at a closed state, so that a corresponding switching circuit also maintains an OFF state, whereby a corresponding electric resistance element cannot be electrically energized.

Conventionally, one thermal head necessarily involves one thermal head driver system as mentioned above, and these two elements are inseparably related to each other. In other words, a thermal head driver system is provided for the purpose of driving only a single thermal head.

SUMMARY OF THE INVENTION

An object of the present invention is to provide a novel thermal head driver system arranged to selectively drive at least two thermal heads in accordance with at least two types of image information data, respectively, without a thermal head driver system being necessary for each thermal head.

Another object of the present invention is to provide a thermal image-forming apparatus including at least two thermal heads, which are selectively driven by the above-mentioned novel thermal head driver system in accordance with at least two types of image information data.

In accordance with an aspect of the present invention, there is provided a thermal head driver system that cyclically and independently drives each of at least two thermal heads having each a plurality of electric resistance elements. The thermal head driver system comprises a storage system that cyclically stores an image information data, the image information data cyclically being each of at least two types of image information data, respectively corresponding to the at least two thermal heads, and a selector system that cyclically and correspondingly selects which thermal head should be driven in accordance with the cyclical storage of the at least two types of image information data in the storage system, such that the electric resistance elements of the thermal head, selected by the selector system, are selectively and electrically energized in accordance with a corresponding type of image information data cyclically stored in the storage system. Preferably, the thermal head driver system further comprises a determiner system that determines a time period over which the thermal head, selected by the selector system, is driven.

The selector system may comprise a signal generator that generates at least two selection-control signals, each of which changes between a first level and a second level, and the cyclical selection of the driving of the at least two thermal heads is performed in accordance with a combination of the levels of the at least two selection-control signals. In this case, when at least one of the at least two selection-control signals is changed from the first level to the second level, one of the thermal heads is correspondingly selected to be driven by the selector system. Also, when the at least two selection-control signals are kept at the first level, none of the thermal heads are selected to be driven by the selector system.

In accordance with another aspect of the present invention, there is provided an image-forming apparatus that forms an image on an image-forming substrate that includes a base member and a layer of microcapsules, coated over the base member, containing a first type of microcapsule filled with a first monochromatic dye, and a second type of microcapsule filled with a second monochromatic dye, the first type of microcapsule exhibiting a first pressure/temperature characteristic such that, when the first type of microcapsule is squashed under a first pressure at a first temperature, the first type of microcapsule breaks discharging the first dye, the second type of microcapsule exhibiting a second pressure/temperature characteristic such that, when the second type of microcapsule is squashed under a second pressure at a second temperature, the second type of microcapsule breaks discharging the second dye. The image-forming apparatus comprises a first pressure applicator that locally exerts the first pressure on the layer of microcapsules, a second pressure applicator that locally exerts the second pressure on the layer of microcapsules, a first thermal head that is driven such that a first localized area of the layer of microcapsules, on which the first pressure is exerted by the first pressure applicator, is heated to the first temperature in accordance with a first image-information data, such that the first type of microcapsule in the first localized area is selectively broken, a second thermal head that is driven such that a second localized area of the layer of microcapsules, on which the second pressure is exerted by the second pressure applicator, is heated to the second temperature in accordance with a second image-information data, such that the second type of microcapsule in the second localized area is selectively squashed, and a thermal head driver system that cyclically and independently controls the driving of the first and second thermal heads, and that is arranged in accordance with the first-mentioned aspect of the present invention.

The layer of microcapsules may further contains a third type of microcapsule filled with a third monochromatic dye, the third type of microcapsule exhibiting a third pressure/temperature characteristic such that, when the third type of microcapsule is squashed under a third pressure at a third temperature, the third type of microcapsule breaks discharging the third dye. In this case, the image-forming apparatus comprises further comprises a third pressure applicator that locally exerts the third pressure on the layer of microcapsules, and a third thermal head that is driven such that a third localized area of the layer of microcapsules, on which the third pressure is exerted by the third pressure applicator, is heated to the third temperature in accordance with a third image-information data, such that the third type of microcapsule in the third localized area is selectively squashed. Also, the thermal head driver system cyclically and independently controls the driving of the first, second and third thermal heads, the storage system cyclically stores an image information data, the image information data cyclically being each of the first, second and third image information data, and the selector system cyclically and correspondingly selects which thermal head should be driven in accordance with the cyclical storage of the first, second and third image information data in the storage system.

The selector system may comprise a signal generator that generates two selection-control signals, each of which changes between a first level and a second level, and the cyclical selection of the driving of the first, second and third thermal heads is performed in accordance with a combination of the levels of the selection-control signals. When at least one of the two selection-control signals is changed from the first level to the second level, one of the first, second and third thermal heads is correspondingly selected to be driven by the selector system. Also, when all of the two selection-control signals are kept at the first level, none of the first, second and third thermal heads is selected to be driven by the selector system.

BRIEF DESCRIPTION OF THE DRAWINGS

These objects and other objects of the present invention will be better understood from the following description, with reference to the accompanying drawings in which:

FIG. 10 is a table for explaining how one of the three thermal heads to be driven is selected by a combination of levels of two selection-control signals inputted to the thermal head driver circuit;

DESCRIPTION OF THE PREFERRED EMBODIMENTS

Figure 1:
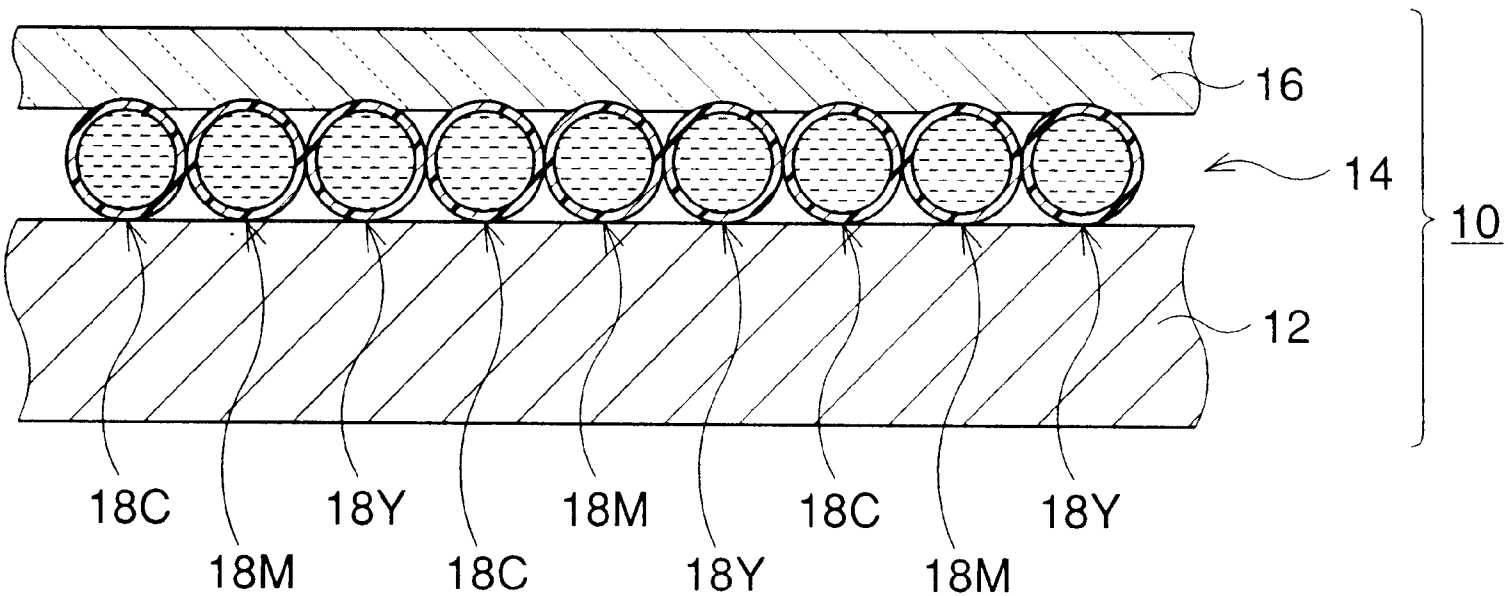
FIG. 1 is a schematic conceptual cross-sectional view showing an image-forming substrate, comprising a layer of microcapsules including a first type of cyan microcapsules filled with a cyan dye, a second type of magenta microcapsules filled with a magenta dye and a third type of yellow microcapsules filled with a yellow dye, used in an image-forming apparatus according to the present invention.

FIG. 1 shows an image-forming substrate, generally indicated by reference 10, which is used in an image-forming apparatus according to the present invention. The image-forming substrate 10 is produced in a form of a paper sheet. Namely, the image-forming substrate or sheet 10 comprises a sheet of paper 12, a layer of microcapsules 14 coated over a surface of the paper sheet 12, and a sheet of protective transparent film 16 covering the microcapsule layer 14.

The microcapsule layer 14 is formed from three types of microcapsules: a first type of microcapsules 18C filled with cyan liquid dye or ink, a second type of microcapsules 18M filled with magenta liquid dye or ink, and a third type of microcapsules 18Y filled with yellow liquid dye or ink, and these microcapsules 18C, 18M and 18Y are uniformly distributed in the microcapsule layer 14. In each type of microcapsule (18C, 18M, 18Y), a shell wall of a microcapsule is formed of a synthetic resin material, usually colored white. Also, each type of microcapsule (18C, 18M, 18Y) may be produced by a well-known polymerization method, such as interfacial polymerization, in-situ polymerization or the like, and may have an average diameter of several microns, for example, 5 $\mu$m to 10 $\mu$m.

Note, when the paper sheet 12 is colored with a single color pigment, the resin material of the microcapsules 18C, 18M and 18Y may be colored by the same single color pigment.

For the uniform formation of the microcapsule layer 14, for example, the same amounts of cyan, magenta and yellow microcapsules 18C, 18M and 18Y are homogeneously mixed with a suitable binder solution to form a suspension, and the paper sheet 12 is coated with the binder solution, containing the suspension of microcapsules 18C, 18M and 18Y, by using an atomizer.

Note, in FIG. 1, for the convenience of illustration, although the microcapsule layer 14 is shown as having a thickness corresponding to the diameter of the microcapsules 18C, 18M and 18Y, in reality, the three types of microcapsules 18C, 18M and 18Y overlay each other, and thus the microcapsule layer 14 has a larger thickness than the diameter of a single microcapsule 18C, 18M or 18Y.

In the image-forming sheet 10, for the resin material of each type of microcapsule (18C, 18M, 18Y), a shape memory resin may be utilized. As is well known, for example, the shape memory resin is represented by a polyurethane-based-resin, such as polynorbornene, trans-1, 4-polyisoprene polyurethane. As other types of shape memory resin, a polyimide-based resin, a polyamide-based resin, a polyvinylchloride-based resin, a polyester-based resin and so on are also known.

Figure 2:
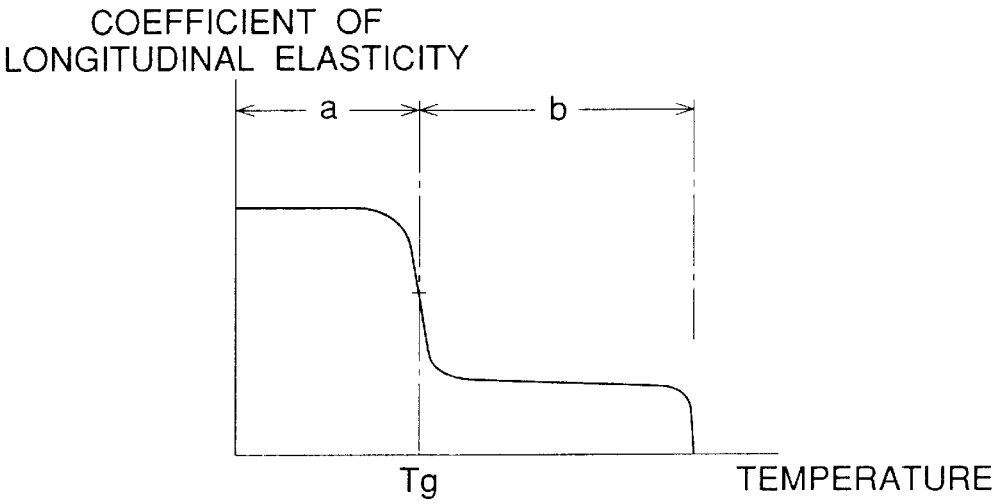
FIG. 2 is a graph showing a characteristic curve of a longitudinal elasticity coefficient of a shape memory resin.

In general, as is apparent from a graph of FIG. 2, the shape memory resin exhibits a coefficient of longitudinal elasticity, which abruptly changes at a glass-transition temperature boundary $T_g$. In the shape memory resin, Brownian movement of the molecular chains is stopped in a low-temperature area "a", which is less than the glass-transition temperature $T_g$, and thus the shape memory resin exhibits a glass-like phase. On the other hand, Brownian movement of the molecular chains becomes increasingly energetic in a high-temperature area "b", which is higher than the glass-transition temperature $T_g$, and thus the shape memory resin exhibits a rubber elasticity.

The shape memory resin is named due to the following shape memory characteristic: after a mass of the shape memory resin is worked into a shaped article in the low-temperature area "a", when such a shaped article is heated over the glass-transition temperature $T_g$, the article becomes freely deformable. After the shaped article is deformed into another shape, when the deformed article is cooled to below the glass-transition temperature $T_g$, the other shape of the article is fixed and maintained. Nevertheless, when the deformed article is again heated to above the glass-transition temperature $T_g$, without being subjected to any load or external force, the deformed article returns to the original shape.

In the image-forming sheet 10, the shape memory characteristic per se is not utilized, but the characteristic abrupt change of the shape memory resin in the longitudinal elasticity coefficient is utilized, such that the three types of microcapsules 18C, 18M and 18Y can be selectively squashed and broken at different temperatures and under different pressures, respectively.

Figure 3:
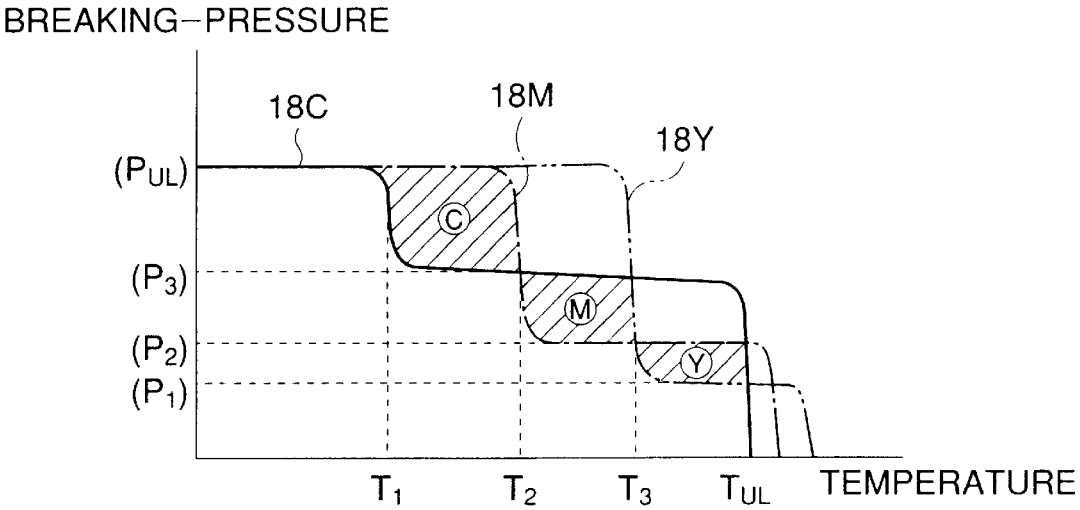
FIG. 3 is a graph showing pressure/temperature breaking characteristics of the respective cyan, magenta and yellow microcapsules shown in FIG. 1, with each of a cyan-developing area, a magenta-developing area and a yellow-developing are indicated as a hatched area.

As shown in a graph of FIG. 3, a shape memory resin of the cyan microcapsules 18C is prepared so as to exhibit a characteristic longitudinal elasticity coefficient, indicated by a solid line, having a glass-transition temperature $T_1$; a shape memory resin of the magenta microcapsules 18M is prepared so as to exhibit a characteristic longitudinal elasticity coefficient, indicated by a single-chained line, having a glass-transition temperature $T_2$; and a shape memory resin of the yellow microcapsules 18Y is prepared so as to exhibit a characteristic longitudinal elasticity coefficient, indicated by a double-chained line, having a glass-transition temperature $T_3$.

Note, by suitably varying compositions of the shape memory resin and/or by selecting a suitable one from among various types of shape memory resin, it is possible to obtain the respective shape memory resins, with the glass-transition temperatures $T_1$, $T_2$ and $T_3$. For example, the glass-transition temperatures $T_1$, $T_2$ and $T_3$ may be set to 70° C., 110° C. and 130° C., respectively.

Figure 4:
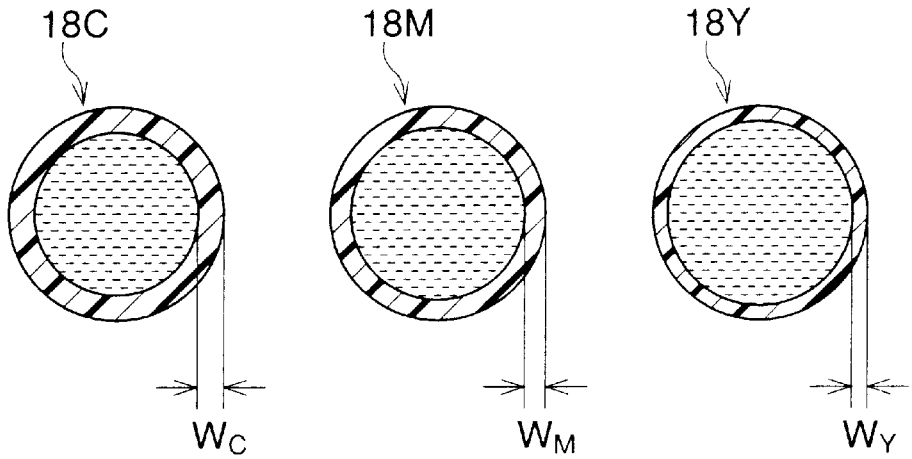
FIG. 4 is a schematic cross-sectional view showing different shell wall thicknesses of the respective cyan, magenta and yellow microcapsules.

As shown in FIG. 4, the microcapsule walls of the cyan microcapsules 18C, magenta microcapsules 18M, and yellow microcapsules 18Y have differing thicknesses $W_C$, $W_M$ and $W_Y$, respectively. Namely, the thickness $W_C$ of cyan microcapsules 18C is larger than the thickness $W_M$ of magenta microcapsules 18M, and the thickness $W_M$ of magenta microcapsules 18M is larger than the thickness $W_Y$ of yellow microcapsules 18Y.

Also, the wall thickness $W_C$ of the cyan microcapsules 18C is selected such that each cyan microcapsule 18C is compacted and broken under a breaking pressure that lies between a critical breaking pressure $P_3$ and an upper limit pressure $P_{UL}$ (FIG. 3), when each cyan microcapsule 18C is heated to a temperature between the glass-transition temperatures $T_1$ and $T_2$; the wall thickness $W_M$ of the magenta microcapsules 18M is selected such that each magenta microcapsule 18M is compacted and broken under a breaking pressure that lies between a critical breaking pressure $P_2$ and the critical breaking pressure $P_3$ (FIG. 3), when each magenta microcapsule 18M is heated to a temperature between the glass-transition temperatures $T_2$ and $T_3$; and the wall thickness $W_Y$ of the yellow microcapsules 18Y is selected such that each yellow microcapsule 18Y is compacted and broken under a breaking pressure that lies between a critical breaking pressure $P_1$ and the critical breaking pressure $P_2$ (FIG. 3), when each yellow microcapsule 18Y is heated to a temperature between the glass-transition temperature $T_3$ and an upper limit temperature $T_{UL}$.

Note, for example, the breaking-pressures $P_1$, $P_2$, $P_3$ and $P_{UL}$ may be set to 0.02, 0.2, 2.0 and 20 MPa, respectively, and a wall thickness of a microcapsule (18C, 18M, 18Y) concerned is selected such that it is compacted and broken under a given breaking pressure when it is heated to a given temperature. Also, note, the upper limit temperature $T_{UL}$ is suitably set to, for example, 150° C.

Thus, by suitably selecting a heating temperature and a breaking pressure, which should be exerted on the image-forming sheet 10, it is possible to selectively squash and break the cyan, magenta and yellow microcapsules 18C, 18M and 18Y.

Figure 5:
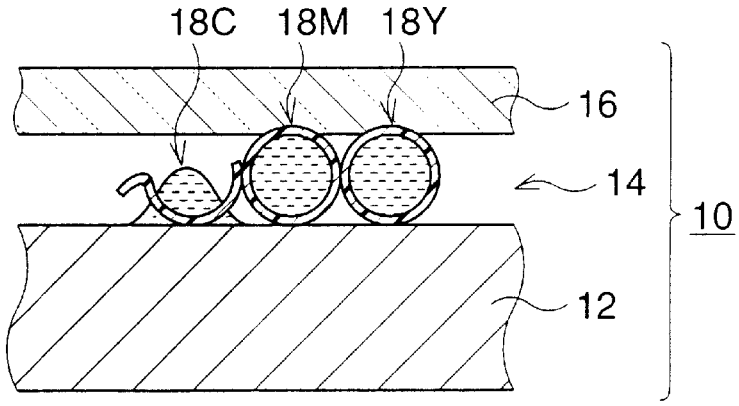
FIG. 5 is a schematic conceptual cross-sectional view similar to FIG. 1, showing only a selective breakage of a cyan microcapsule in the layer of microcapsules.

For example, if the selected heating temperature and breaking pressure fall within a hatched cyan-developing area C (FIG. 3), defined by a temperature ranging between the glass-transition temperatures $T_1$ and $T_2$ and by a pressure ranging between the critical breaking pressure $P_3$ and the upper limit pressure $P_{UL}$, only the cyan microcapsules 18C are squashed and broken, as representatively shown in FIG. 5. Also, if the selected heating temperature and breaking pressure fall within a hatched magenta-developing area M, defined by a temperature ranging between the glass-transition temperatures $T_2$ and $T_3$ and by a pressure ranging between the critical breaking pressures $P_2$ and $P_3$, only the magenta microcapsules 18M are squashed and broken. Further, if the selected heating temperature and breaking pressure fall within a hatched yellow-developing area Y, defined by a temperature ranging between the glass-transition temperature $T_3$ and the upper limit temperature $T_{UL}$ and by a pressure ranging between the critical breaking pressures $P_1$ and $P_2$, only the yellow microcapsules 18Y are squashed and broken.

Accordingly, if the selection of a heating temperature and a breaking pressure, which should be exerted on the image-forming sheet 10, are suitably controlled in accordance with a series of digital color image-pixel signals: digital cyan image-pixel signals, digital magenta image-pixel signals and digital yellow image-pixel signals, it is possible to form a color image on the image-forming sheet 10 on the basis of the digital color image-pixel signals.

Figure 6:
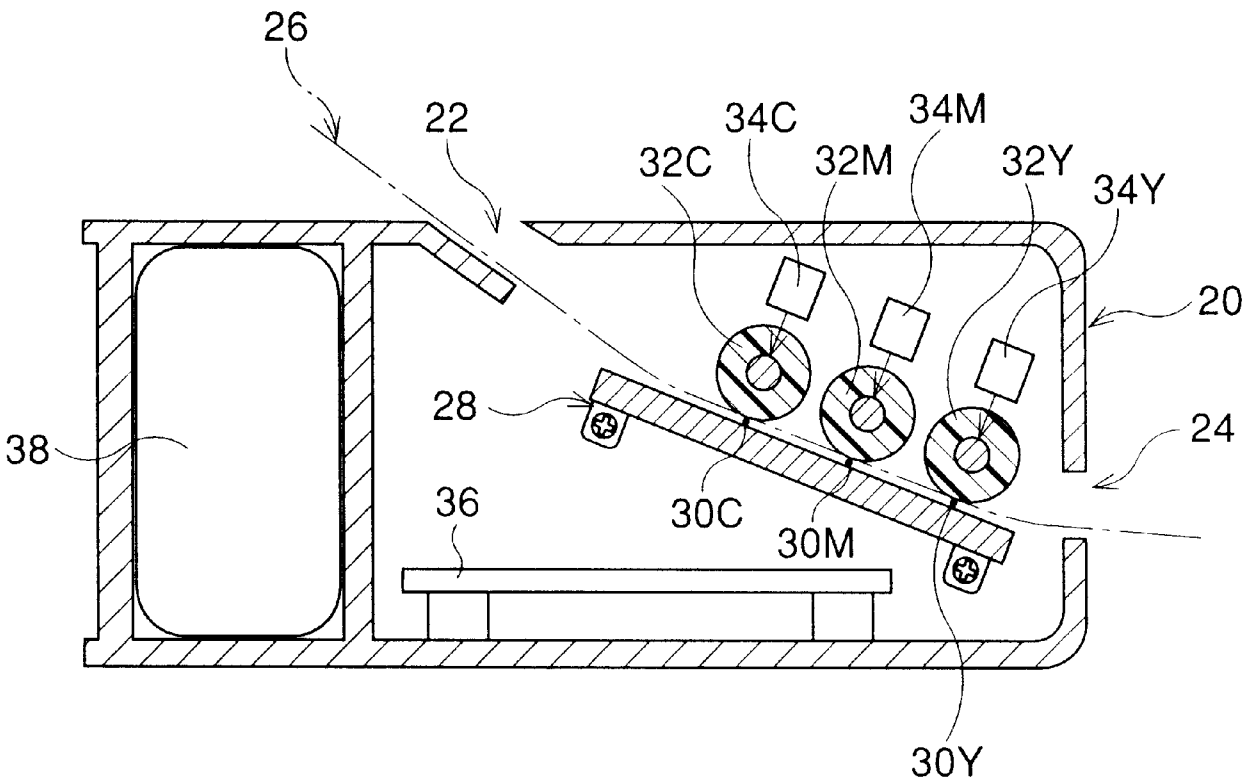
FIG. 6 a schematic cross-sectional view of an image-forming apparatus, according to the present invention, for forming a color image on the image-forming substrate shown in FIG. 1.

With reference to FIG. 6, the image-forming apparatus according to the present invention is schematically shown, and is constituted as a line color printer so as to form a color image on the aforementioned image-forming sheet 10.

The color printer comprises a rectangular parallelopiped housing 20 having an entrance opening 22 and an exit opening 24 formed in a top wall and a side wall of the housing 20, respectively. The image-forming sheet 10 (not shown in FIG. 6) is introduced into the housing 20 through the entrance opening 22, and is then discharged from the exit opening 24 after the formation of a color image on the image-forming sheet 10. Note, in FIG. 6, a path 26 for movement of the image-forming sheet 10 is indicated by a chained line.

A guide plate 28 is provided in the housing 20 so as to define a part of the path 26 for the movement of the image-forming sheet 10, and a first thermal head 30C, a second thermal head 30M and a third thermal head 30Y are securely attached to a surface of the guide plate 28. Each thermal head (30C, 30M, 30Y) is formed as a line thermal head perpendicularly extended with respect to a direction of the movement of the image-forming sheet 10.

Figure 7:
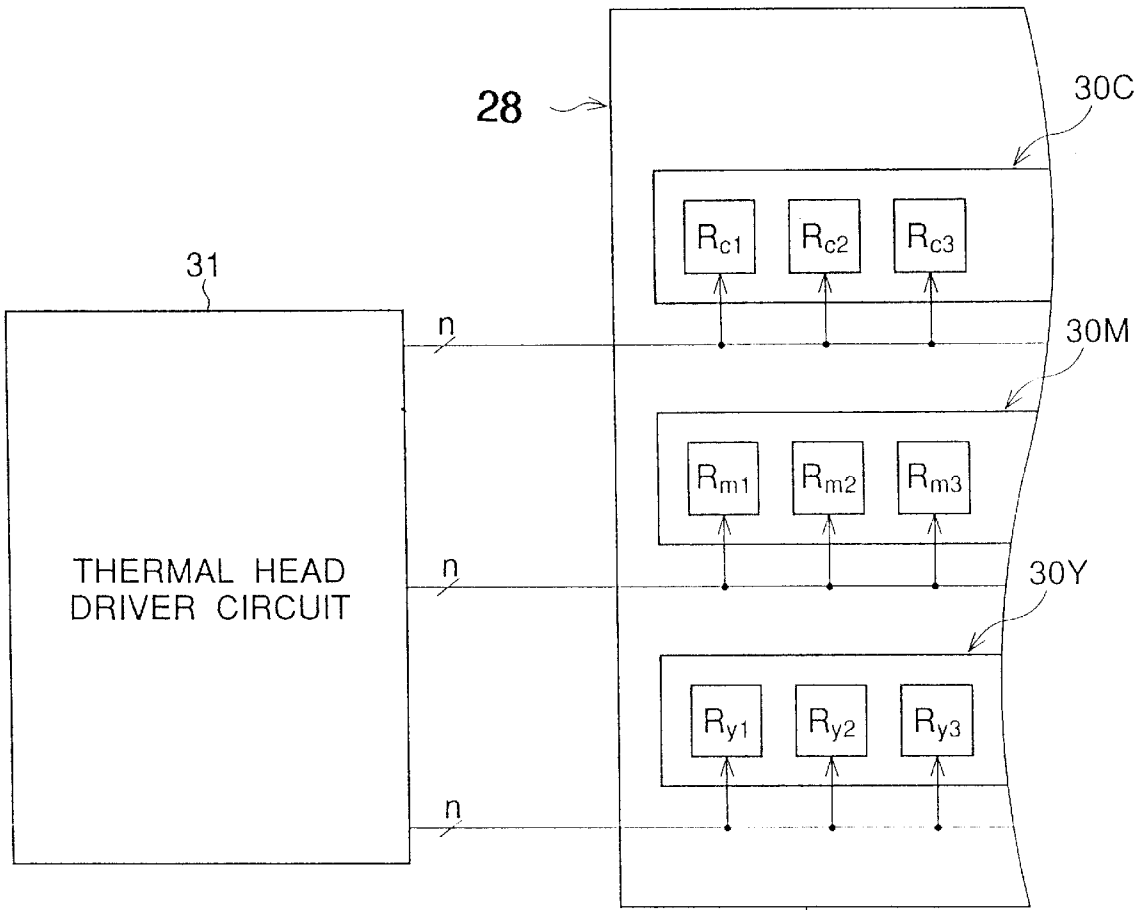
FIG. 7 is a partial schematic block diagram of three line-type thermal heads and a thermal head driver circuit therefor incorporated in the color printer of FIG. 6.

As conceptually shown in FIG. 7, the line thermal head 30C includes a plurality of heater elements or electric resistance elements $R_{c1}$ to $R_{cn}$ (where n=1, 2, 3, . . . ), and these electric resistance elements $R_{c1}$ to $R_{cn}$ are linearly aligned with respect to each other along a length of the line thermal head 30C. Also, the line thermal head 30M includes a plurality of electric resistance elements $R_{m1}$ to $R_{mn}$ (where n=1, 2, 3, . . . ), and these electric resistance elements $R_{m1}$ to $R_{mn}$ are linearly aligned with respect to each other along a length of the line thermal head 30M. Similarly, the line thermal head 30Y includes a plurality of electric resistance elements $R_{y1}$ to $R_{yn}$ (where n=1, 2, 3, . . . ), and these resistance elements are linearly aligned with respect to each other along a length of the line thermal head 30Y.

According to the present invention, each of the electric resistance elements ($R_{c1}$ to $R_{cn}$; $R_{m1}$ to $R_{mn}$; and $R_{y1}$ to $R_{yn}$) is selectively energized by a thermal head driver circuit 31 in accordance with a corresponding monochromatic (cyan, yellow, magenta) digital image-pixel signal in a manner as stated in detail hereinafter. Of course, when a digital cyan image-pixel signal has a value "1", a corresponding electric resistance element $R_{cn}$ is heated to a temperature, which falls in the range between the glass-transition temperatures $T_1$ and $T_2$; when a digital magenta image-pixel signal has a value "1", a corresponding electric resistance element $R_{mn}$ is heated to a temperature, which falls in the range between the glass-transition temperatures $T_2$ and $T_3$; when the digital yellow image-pixel signal has a value "1", the corresponding electric resistance element $R_{yn}$ is heated to a temperature, which falls in the range between the glass-transition temperature $T_3$ and the upper limit temperature $T_{UL}$.

Note, the line thermal heads 30C, 30M and 30Y are arranged in sequence so that the respective heating temperatures increase in the movement direction of the image-forming substrate 10.

As shown in FIG. 6, the color printer further comprises a first roller platen 32C, a second roller platen 32M and a third roller platen 32Y associated with the first, second and third thermal heads 30C, 30M and 30Y, respectively, and each of the roller platens 32C, 32M and 32Y may be formed of a suitable hard rubber material. The first roller platen 32C is provided with a first spring-biasing unit 34C so as to be elastically pressed against the first thermal head 30C at a pressure between the critical compacting-pressure $P_3$ and the upper limit pressure $P_{UL}$; the second roller platen 32M is provided with a second spring-biasing unit 34M so as to be elastically pressed against the second thermal head 30M at a pressure between the critical compacting-pressures $P_2$ and $P_3$; and the third roller platen 32Y is provided with a third spring-biasing unit 34Y so as to be elastically pressed against the second thermal head 30Y at a pressure between the critical compacting-pressures $P_1$ and $P_2$.

During a printing operation, the respective roller platens 32C, 32M and 32Y are intermittently rotated in a counter-clockwise direction (FIG. 6) with a same peripheral speed. Accordingly, the image-forming sheet 10, introduced through the entrance opening 22, intermittently moves toward the exit opening 24 along the path 26. Thus, the image-forming sheet 10 is subjected to pressure ranging between the critical breaking-pressure $P_3$ and the upper limit pressure $P_{UL}$ when passing between the first line thermal head 30C and the first roller platen 32C; to pressure ranging between the critical breaking-pressures $P_2$ and $P_3$ when passing between the second line thermal head 30M and the second roller platen 32M; and to pressure ranging between the critical breaking-pressures $P_1$ and $P_2$ when passing between the third line thermal head 30Y and the third roller platen 32Y. Namely, the roller platens 32C, 32M and 32Y are arranged in sequence so that the respective pressures, exerted by the platens 32C, 32M and 32Y on the line thermal heads 30C, 30M and 30Y, decrease in the movement direction of the image-forming substrate 10.

Note, the introduction of the image-forming sheet 10 into the entrance opening 22 of the printer is carried out such that the transparent protective film sheet 16 of the image-forming sheet 10 comes into contact with the thermal heads 30C, 30M and 30Y.

With the arrangement of the above-mentioned line printer, for example, when one of the electric resistance elements $R_{cn}$ is heated to a temperature in the range between the glass-transition temperatures $T_1$ and $T_2$, a cyan dot, having a dot size (diameter) of 50 $\mu$m to 100 $\mu$m, is developed on the microcapsule layer 14 of the image-forming sheet 10, because only the cyan microcapsules 18C are squashed and broken at a dot area heated by the resistance element ($R_{cn}$) concerned. Of course, although a plurality of cyan, magenta and yellow microcapsules 18C, 18M and 18Y are uniformly included in a dot area (50 $\mu$m to 100 $\mu$m) to be developed on the microcapsule layer 14, it is possible to squash and break only the cyan microcapsules 18C, because the heating temperature is within the range between the glass-transition temperatures $T_1$ and $T_2$.

In FIG. 6, reference 36 indicates a control circuit board for controlling a printing operation of the color printer, and reference 38 indicates an electrical main power source for electrically energizing the control circuit board 36.

Figure 8:
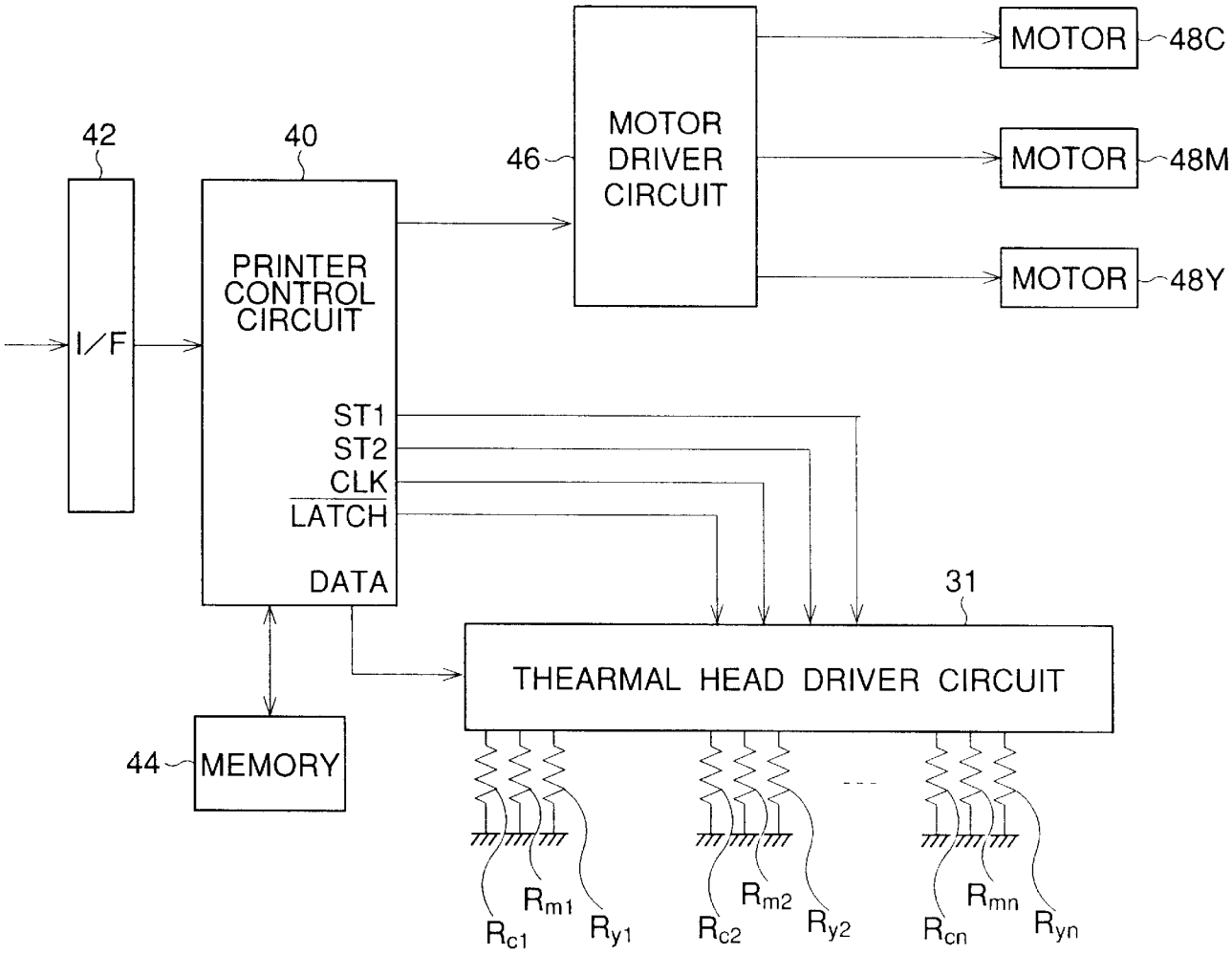
FIG. 8 is a schematic block diagram of a control circuit board of the color printer shown in FIG. 6.

FIG. 8 shows a schematic block diagram of the control circuit board 36. As shown in this drawing, the control circuit board 36 comprises a printer control circuit 40 including a microcomputer. The printer control circuit 40 receives a series of digital color image-pixel signals from a personal computer or a word processor (not shown) through an interface circuit (I/F) 42. The received digital color image-pixel signals are suitably processed and are converted into a frame of digital cyan image-pixel signals, a frame of digital magenta image-pixel signals, and a frame of digital yellow image-pixel signals, and these frames of digital color image-pixel signals are once stored in a memory 44.

Also, the control circuit board 36 is provided with a motor driver circuit 46 for driving three electric motors 48C, 48M and 48Y, which are used to rotationally drive the roller platens 32C, 32M and 32Y, respectively. In this embodiment of the color printer, each of the motors 48C, 48M and 48Y is a stepping motor, which is driven in accordance with a series of drive pulses outputted from the motor driver circuit 46, the outputting of drive pulses from the motor driver circuit 46 to the motors 48C, 48M and 48Y being controlled by the printer control circuit 40.

As shown in FIG. 8, the thermal head driver circuit 31 for the line thermal heads 30C, 30M and 30Y is included in the control circuit board 36, and is controlled by a set of selection-control signals "ST1" and "ST2", a series of clock pulses "CLK", a low-active latch signal "LATCH" and a series of digital color image-pixel signals "DATA", which are outputted from the printer control circuit 40.

Figure 9:
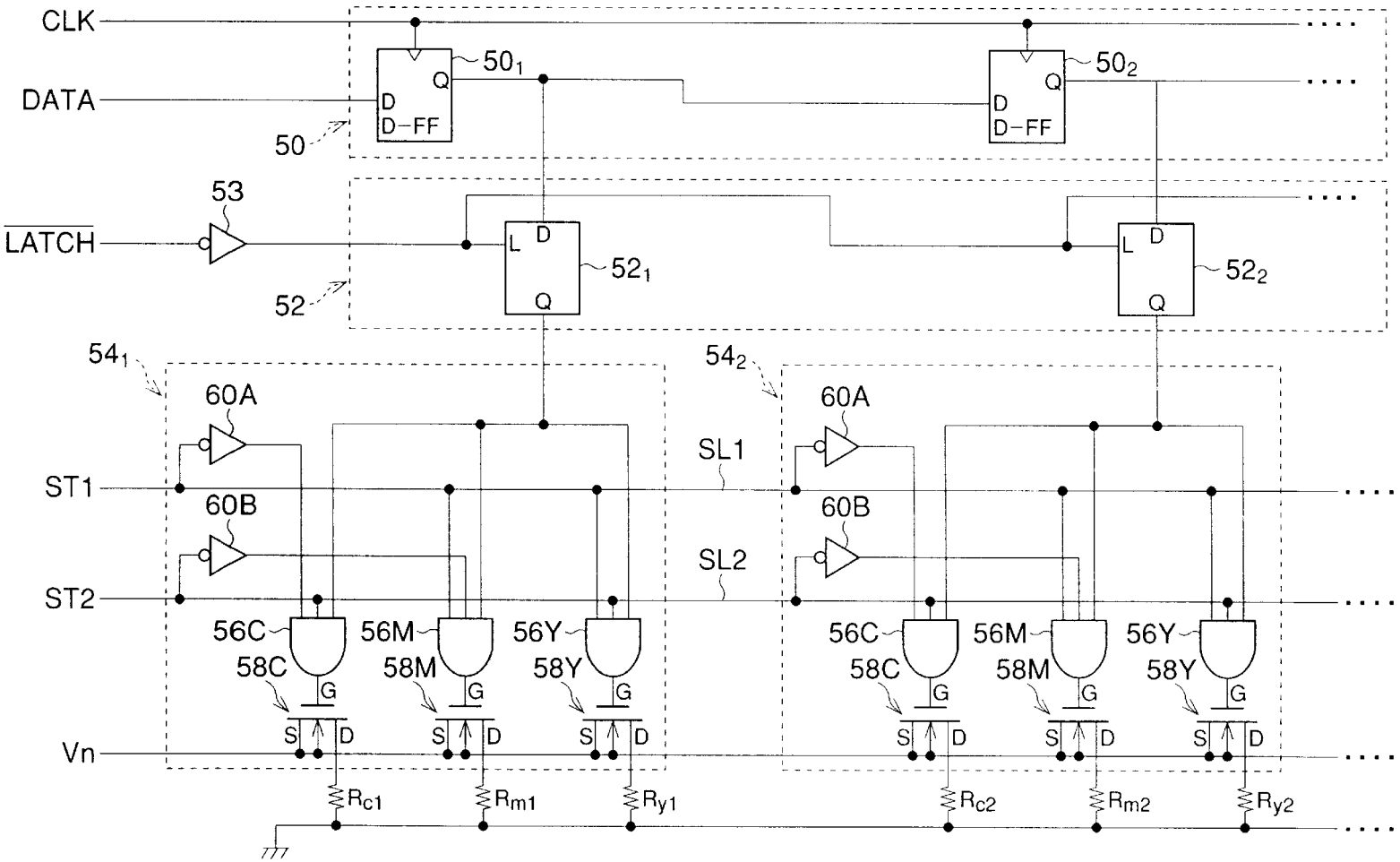
FIG. 9 is a partial schematic wiring diagram of the thermal head driver circuit of FIGS. 7 and 8.

FIG. 9 partially shows an arrangement of the thermal head driver circuit 31. As is apparent from this drawing, the thermal head driver circuit 31 comprises a shift register 50 including a plurality of D-type flip-flops $\mathbf{50}_1$ to $\mathbf{50}_n$ (where n=1, 2, 3, . . . ), and a latch circuit 52 including a plurality of D-type latches $\mathbf{52}_1$ to $\mathbf{52}_n$ (where n=1, 2, 3, . . . ). During a printing operation, a single-line of monochromatic (cyan, magenta, yellow) digital image-pixel signals "DATA" is read from the memory 44, and is then inputted to the shift register 50.

While the series of monochromatic digital image-pixel signals "DATA" is inputted to the shift register 50, these digital image-pixel signals are successively shifted to the flip-flops $\mathbf{50}_1$ to $\mathbf{50}_n$ in accordance with the series of clock pulses "CLK". Then, the respective monochromatic image-pixel signals held by the flip-flops $\mathbf{50}_1$ to $\mathbf{50}_n$ are simultaneously shifted to the latches $\mathbf{52}_1$ to $\mathbf{52}_n$ of the latch circuit 52, and are latched by outputting the low-active latch signal "LATCH" from the printer control circuit 40 to the latch circuit 52 through an invertor 53 (FIG. 9), whereby the respective digital image-pixel signals are stably held in the latches $\mathbf{52}_1$ to $\mathbf{52}_n$. Thus, either a high-level signal or a low-level signal is stably outputted from a Q-terminal of each latch ($\mathbf{52}_1$, . . . , $\mathbf{52}_n$) in accordance with binary values of a corresponding monochromatic digital image-pixel signal held therein. Namely, when the digital image-pixel signal has a value "1", the high-level signal is outputted from the Q-terminal of the corresponding latch ($\mathbf{52}_1$, . . . , $\mathbf{52}_n$), and, when the digital image-pixel signal has a value "0", the low-level signal is outputted from the Q-terminal of the corresponding latch ($\mathbf{52}_1$, . . . , $\mathbf{52}_n$).

The thermal head driver circuit 31 further comprises a plurality of driver circuit elements $\mathbf{54}_1$ to $\mathbf{54}_n$ (where n=1, 2, 3, . . . ). Each of the driver circuit elements $\mathbf{54}_1$ to $^{54}{}_n$ includes a set of AND-gate circuits 56C, 56M and 56Y, a set of field-effect transistors (FET) 58C, 58M and 58Y, and a pair of invertors 60A and 60B, all being wired in a manner as shown in FIG. 9.

In particular, each of the AND-gate circuits 56C, 56M and 56Y has three input terminals, one of which is connected to the Q-terminal of the corresponding latch ($\mathbf{52}_1$, . . . , $\mathbf{52}_n$), and the respective remaining input terminals of each AND-gate circuit (56C, 56M, 56Y) are connected to two signal lines SL1 and SL2, through which the selection-control signals "ST1" and "ST1" are fed, respectively. Note, as shown in FIG. 9, the invertor 60A is interposed between the signal line SL1 and the corresponding input terminal of the AND-gate circuit 56C, and the inverter 60B is interposed between the signal line SL2 and the corresponding input terminal of the AND-gate circuit 56M.

Also, each of the AND-gate circuits 56C, 56M and 56Y has an output terminal, which is connected to a gate (G) of the corresponding FET (58C, 58M, 58Y) A source (S) of each FET (58C, 58M, 58Y) is connected to an electric power source ($V_h$), and respective drains (D) of the FETs 58C, 58M and 58Y are connected to the electric resistance elements $R_{cn}$, $R_{mn}$ and $R_{yn}$. Of course, when an output level of each AND gate circuit (56C, 56M, 56Y) is changed from a low-level to a high-level, the corresponding FET (58C, 58M, 58Y) is turned ON, so that the corresponding electric resistance element ($R_{cn}$, $R_{mn}$, $R_{yn}$) is electrically energized.

With the arrangement of the aforementioned thermal head driver circuit 31, usually both the selection-control signals "ST1" and "ST2" are maintained at a low-level under control of the printer control circuit 40, so that all the output levels of the AND-gate circuit (56C, 56M and 56Y) are also maintained at the low-level, whereby all the electric resistance elements $R_{cn}$, $R_{mn}$ and $R_{yn}$ cannot be electrically energized.

When the digital cyan image-pixel signals included in the single-line are held in the respective latches $\mathbf{52}_1$ to $\mathbf{52}_n$, and when these latches $\mathbf{52}_1$ to $\mathbf{52}_n$ are latched, only an output level of the selection-control signal "ST2" is changed from the low-level to a high-level, so that only the respective electric resistance elements $R_{c1}$ to $R_{cn}$ are selectively energized in accordance with the digital cyan image-pixel signals held in the latches $\mathbf{52}_1$ to $\mathbf{52}_n$. Namely, for example, when the digital cyan image-pixel signal held in the latch $\mathbf{52}_1$ has a value "1", the output level of the corresponding AND-gate circuit 56C is changed from the low-level to the high-level, whereby the corresponding electric resistance element $R_{c1}$ is electrically energized. On the other hand, when the digital cyan image-pixel signal held in the latch $\mathbf{52}_1$ has a value "0", the output level of the corresponding AND-gate circuit 56C is maintained at the low-level, whereby the corresponding electric resistance element $R_{c1}$ cannot be electrically energized.

When the digital magenta image-pixel signals included in the single-line are held in the respective latches $\mathbf{52}_1$ to $\mathbf{52}_n$, and when these latches $\mathbf{52}_1$ to $\mathbf{52}_n$ are latched, only an output level of the selection-control signal "ST1" is changed from the low-level to a high-level, so that only the respective electric resistance elements $R_{m1}$ to $R_{mn}$ are selectively energized in accordance with the digital magenta image-pixel signals held in the latches $\mathbf{52}_1$ to $\mathbf{52}_n$. Namely, for example, when the digital magenta image-pixel signal held in the latch $\mathbf{52}_1$ has a value "1", the output level of the corresponding AND-gate circuit 56M is changed from the low-level to the high-level, whereby the corresponding electric resistance element $R_{m1}$ is electrically energized. On the other hand, when the digital magenta image-pixel signal held in the latch $\mathbf{52}_1$ has a value "0", the output level of the corresponding AND-gate circuit 56M is maintained at the low-level, whereby the corresponding electric resistance element $R_{m1}$ cannot be electrically energized.

When the digital yellow image-pixel signals included in the single-line are held in the respective latches $\mathbf{52}_1$ to $\mathbf{52}_n$, and when these latches $\mathbf{52}_1$ to $\mathbf{52}_n$ are latched, both output levels of the selection-control signals "ST1" and "ST2" are changed from the low-level to the high-level, so that only the respective electric resistance elements $R_{y1}$ to $R_{yn}$ are selectively energized in accordance with the digital yellow image-pixel signals held in the latches $\mathbf{52}_1$ to $\mathbf{52}_n$. Namely, for example, when the digital yellow image-pixel signal held in the latch $\mathbf{52}_1$ has a value "1", the output level of the corresponding AND-gate circuit 56Y is changed from the low-level to the high-level, whereby the corresponding electric resistance element $R_{y1}$ is electrically energized. On the other hand, when the digital yellow image-pixel signal held in the latch $\mathbf{52}_1$ has a value "0", the output level of the corresponding AND-gate circuit 56Y is maintained at the low-level, whereby the corresponding electric resistance element $R_{y1}$ cannot be electrically energized.

In short, by a combination of the levels of the selection-control signals "ST1" and "ST2", it is possible to select which thermal head (30C, 30M, 30Y) should be driven so that the electric resistance elements ($R_{c1}$ to $R_{cn}$; $R_{m1}$ to $R_{mn}$; $R_{y1}$ to $R_{yn}$) included in the corresponding thermal head (30C, 30M, 30Y) are selectively and electrically energized, as shown in a TABLE of FIG. 10.

Whenever the electric resistance elements $R_{c1}$ to $R_{cn}$ are selectively and electrically energized, the electrical energization is continued until the electrically-energized electric resistance elements ($R_{cn}$) are heated to a temperature between the glass-transition temperatures $T_1$ and $T_2$, and the electrical energization is stopped by returning the high-level of the selection-control signal "ST2" to the low-level when the heated resistance elements ($R_{cn}$) have reached the temperature between the glass-transition temperatures $T_1$ and $T_2$. For example, a period of the electrical energization of the electric resistance elements ($R_{cn}$) may be set to 3 ms.

Whenever the electric resistance elements $R_{m1}$ to $R_{mn}$ are selectively and electrically energized, the electrical energization is continued until the electrically-energized electric resistance elements ($R_{mn}$) are heated to a temperature between the glass-transition temperatures $T_2$ and $T_3$, and the electrical energization is stopped by returning the high-level of the selection-control signal "ST1" to the low-level when the heated resistance elements ($R_{mn}$) have reached the temperature between the glass-transition temperatures $T_2$ and $T_3$. For example, a period of the electrical energization of the electric resistance elements ($R_{mn}$) may be set to 4 ms.

Whenever the electric resistance elements $R_{y1}$ to $R_{yn}$ are selectively and electrically energized, the electrical energization is continued until the electrically-energized electric resistance elements ($R_{yn}$) are heated to a temperature between the glass-transition temperature $T_3$ and the upper limit temperature $T_{UL}$, and the electrical energization is stopped by returning the high-levels of the selection-control signals "ST1" and "ST2" to the low-levels when the heated resistance elements ($R_{yn}$) have reached the temperature between the glass-transition temperature $T_3$ and the upper limit temperature $T_{UL}$. For example, a period of the electrical energization of the electric resistance elements ($R_{cn}$) may be set to 5 ms.

Figure 11:
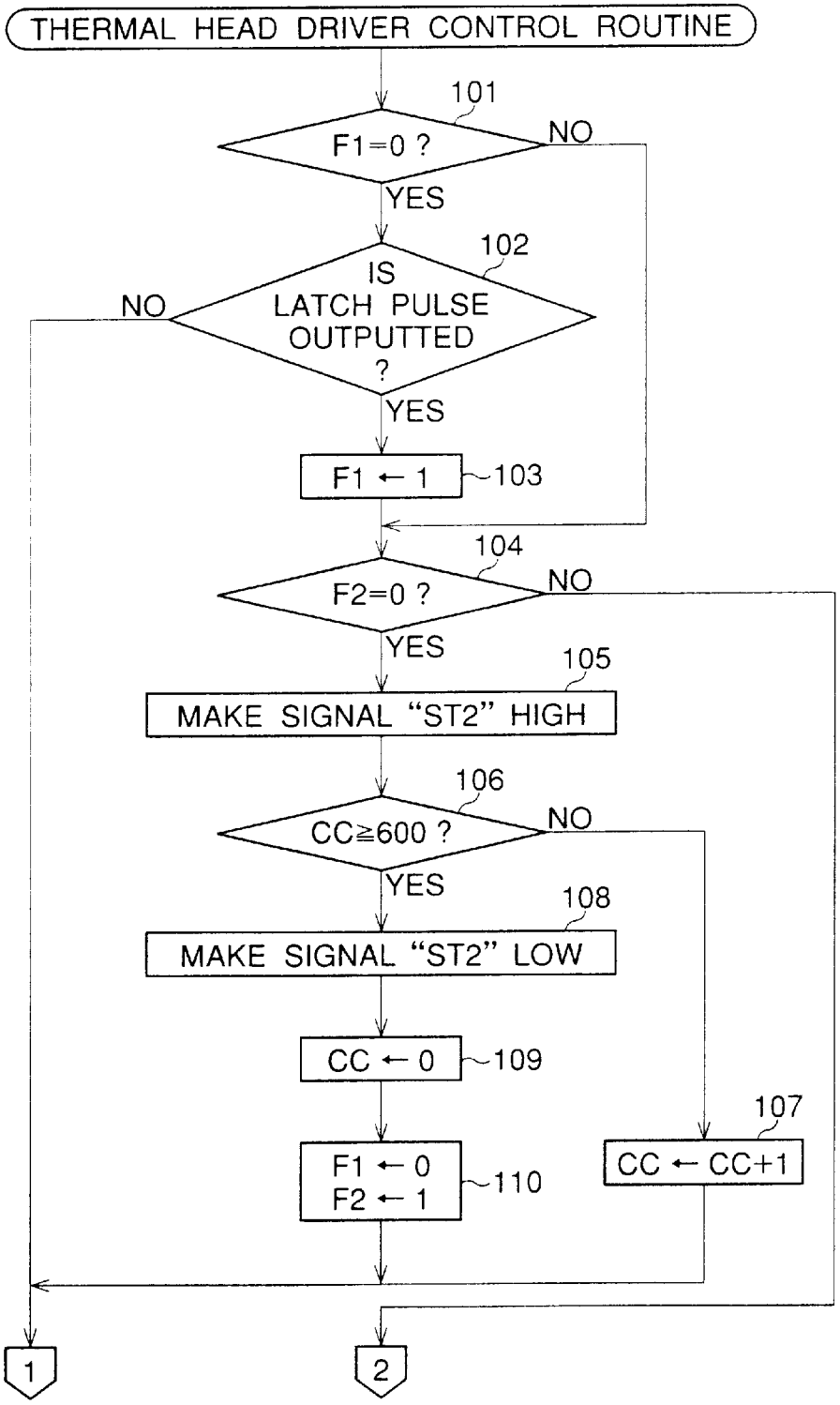
FIG. 11 is a part of a flowchart of a thermal-head-driver control routine executed in a printer control circuit of FIG. 8.
Figure 12:
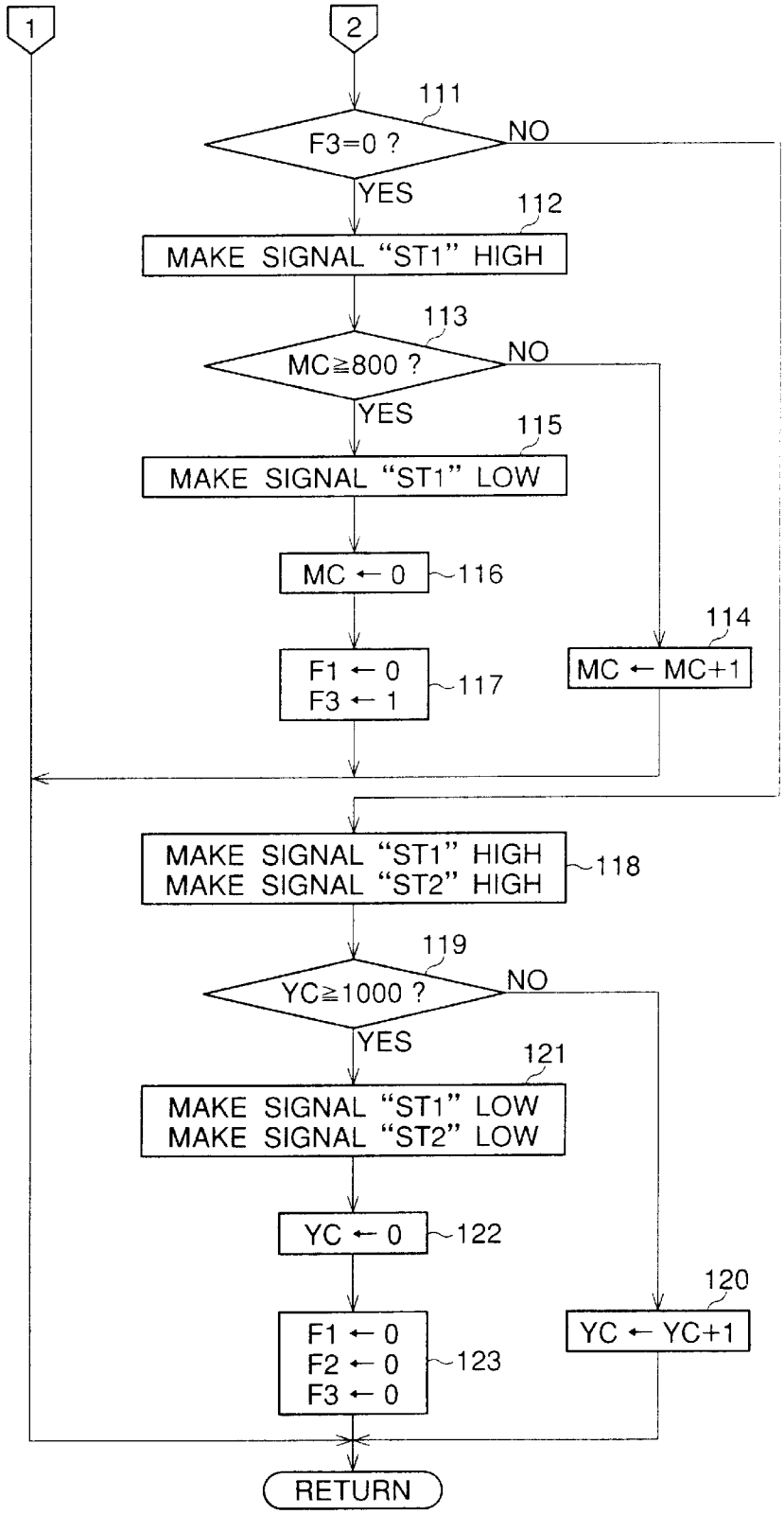
FIG. 12 is the remaining part of the flowchart of the thermal-head-driver control routine executed in the printer control circuit of FIG. 8.

FIGS. 11 and 12 show a flowchart of a thermal-head-driver control routine executed by the printer control circuit 40. This thermal-head-driver control routine is constituted as a time-interruption routine which is repeatedly executed at regular intervals of, for example, 5 $\mu$s, and the execution of this routine is started when the printer control circuit 40 receives a printing-operation-start signal from a personal computer or a word processor (not shown) through the interface circuit (I/F) 42.

In this embodiment, the execution of the thermal-head-driver control routine is performed under the following conditions:

(a) During the printing operation, three single-lines three-primary color (cyan, magenta and yellow) digital image-pixel signals are successively read in a cycle from the memory 44, and are outputted from the printer control circuit 40 to the shift register 50 in the order of a single-line of cyan digital image-pixel signals, a single-line of magenta digital image-pixel signals and a single-line of yellow digital image-pixel signals, before the cycle is again repeated. Also, the low-active latch signal "LATCH" cyclically produces three latch pulses: a first latch pulse for latching the cyan digital image-pixel signals, a second latch pulse for latching the magenta digital image-pixel signals, and a third latch pulse the yellow digital image-pixel signals;

(b) The thermal heads 30C, 30M and 30Y are spaced apart from each other by a distance corresponding to, for example, 200 single-lines of image-dots recorded on the image-forming sheet 10. For this reason, the single-line of magenta digital image-pixel signals is repeatedly outputted as a dummy single-line of image-pixel signals, all having a value "0", until the first single-line of cyan image-dots, recorded by the alignment of electric resistance elements $R_{c1}$ to $R_{cn}$ of the thermal head 30C, reaches the alignment of electric resistance elements $R_{m1}$ to $R_{mn}$ of the thermal head 30M, and the single-line of yellow digital image-pixel signals is also repeatedly outputted as a dummy single-line of image-pixel signals, all having a value "0", until the first single-line of cyan image-dots, recorded by the alignment of electric resistance elements $R_{c1}$ to $R_{cn}$ of the thermal head 30C, reaches the alignment of electric resistance elements $R_{y1}$ to $R_{yn}$ of the thermal head 30Y; and (c) For the same reason, the single-line of cyan digital image-pixel signals is repeatedly outputted as a dummy single-line of image-pixel signals, all having a value "0", until the last single-line of cyan image-dots, recorded by the alignment of electric resistance elements $R_{c1}$ to $R_{cn}$ of the thermal head 30C, reaches the alignment of electric resistance elements $R_{y1}$ to $R_{yn}$ of the thermal head 30Y, and the single-line of magenta digital image-pixel signals is also repeatedly outputted as a dummy single-line of image-pixel signals, all having a value "0", until the last single-line of magenta image-dots, recorded by the alignment of electric resistance elements $R_{m1}$ to $R_{mn}$ of the thermal head 30M reaches the alignment of electric resistance elements $R_{y1}$ to $R_{yn}$ of the thermal head 30Y.

With reference to a timing chart shown in FIG. 13, the thermal-head-driver control routine will be now explained below.

At step 101, it is determined whether a flag F1 is "0" or "1". At an initial stage in which the printing operation has just begun, since F1=0, the control proceeds to step 102, and it is determined whether a first latch pulse of the low-active latch signal "LATCH", indicated by reference LAT1 in the timing chart of FIG. 13, is outputted from the printer control circuit 40 to the latch circuit 52. If the outputting of the first latch pulse "LAT1" is not confirmed, the routine once ends. Thereafter, although the routine is repeatedly executed at regular intervals of 5 $\mu$s, there is no progress until the outputting of the first latch pulse "LAT1" is confirmed.

Figure 13:
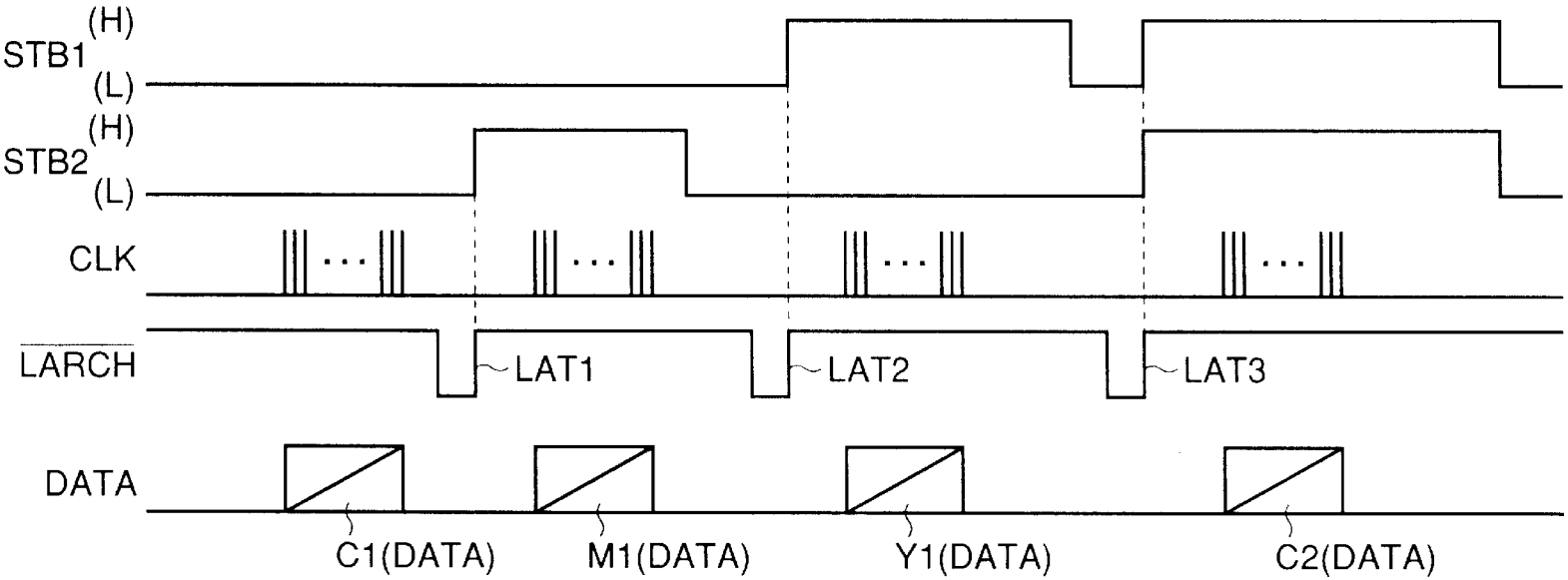
FIG. 13 is a timing chart used to explain the thermal-head-driver control routine shown in FIGS. 11 and 12.

In the beginning of the printing operation, a first single-line of digital cyan image-pixel signals, indicated by reference C1(DATA), is inputted in the shift register 50, and these digital cyan image-pixel signals C1(DATA) are successively shifted to the flip-flops $\mathbf{50}_1$ to $\mathbf{50}_n$ in accordance with the series of clock pulses "CLK", as shown in the timing chart of FIG. 13. Then, the respective digital cyan image-pixel signals C1(DATA) held by the flip-flops $\mathbf{50}_1$ to $\mathbf{50}_n$ are simultaneously shifted to the latches $\mathbf{52}_1$ to $\mathbf{52}_n$ of the latch circuit 52, and are latched by an outputting of the first latch pulse "LAT1".

At step 102, when the outputting of the first latch pulse "LAT1" is confirmed, the control proceeds to step 103, in which the flag F1 is made to be "1". Then, at step 104, it is determined whether a flag F2 is "0" or "1". At the initial stage, since F2=0, the control proceeds to step 105, in which the selection-control signal "ST2" is made to be high, whereby only the electric resistance elements $R_{c1}$ to $R_{cn}$ of the thermal head 30C are selectively and electrically energized in accordance with the cyan image-pixel signals C1(DATA) held in the latches $\mathbf{52}_1$ to $\mathbf{52}_n$ of the latch circuit 52.

At step 106, it is determined whether a count number of a counter CC has reached a numerical value of 600, which corresponds to a time period of 3 ms (3 ms/5 μs=600). At the initial stage, since CC=0, the control proceeds to step 107, in which the count number of the counter CC is incremented by "1". Then, the routine once ends. Thereafter, although the routine is repeatedly executed at regular intervals of 5 μs, the incrementing of the count number of the counter CC is merely carried out until the count number of the counter CC reaches the numerical value of 600 (with F1=1 and F2=0).

At step 106, when it is confirmed that the count number of the counter CC has reached the numerical value of 600, the control proceeds from step 106 to step 108, in which the selection-control signal "ST2" is returned to the low-level, so that the selective and electrical energization of the electric resistance elements $R_{c1}$ to $R_{cn}$ of the thermal head 30C is stopped.

At step 109, the counter CC is reset to "0". Then, at step 110, the flag F1 is made to be "0", and the flag F2 is made to be "1". Thus, the routine once ends.

When the routine is executed after the time of 5 μs has elapsed, the control proceeds to step 102 via step 101 (F1=0 at step 110), in which it is determined whether a second latch pulse of the low-active latch signal "LATCH", indicated by reference LAT2 in the timing chart of FIG. 13, is outputted from the printer control circuit 40 to the latch circuit 52. If the outputting of the second latch pulse "LAT2" is not confirmed, the routine once ends. Thereafter, although the routine is repeatedly executed at regular intervals of 5 μs, there is no progress until the outputting of the second latch pulse "LAT2" is confirmed.

As is apparent from the timing chart of FIG. 13, during the selective and electrical energization of the electric resistance elements $R_{c1}$ to $R_{cn}$ of the thermal head 30C, a first single-line of digital magenta image-pixel signals, indicated by reference M1(DATA), is inputted to the shift register 50, and these digital magenta image-pixel signals M1 (DATA) are successively shifted to the flip-flops $\mathbf{50}_1$ to $\mathbf{50}_n$ in accordance with the series of clock pulses "CLK", as shown in the timing chart of FIG. 13. Then, the respective digital magenta image-pixel signals M1 (DATA) held by the flip-flops $\mathbf{50}_1$ to 50 are simultaneously shifted to the latches $\mathbf{52}_1$ to $\mathbf{52}_n$ of the latch circuit 52, and are latched by an outputting of the second latch pulse "LAT2".

At step 102, when the outputting of the second latch pulse "LAT2" is confirmed, the control proceeds to step 103, in which the flag F1 is made to be "1". Then, the control jumps from step 104 to step 111 (F2=1), in which it is determined whether a flag F3 is "0" or "1". At the initial stage, since F3=0, the control proceeds to step 112, in which the selection-control signal "ST1" is made to be high, whereby only the electric resistance elements $R_{m1}$ to $R_{mn}$ of the thermal head 30M are selectively and electrically energized in accordance with the magenta image-pixel signals M1(DATA) held in the latches $\mathbf{52}_1$ to $\mathbf{52}_n$of the latch circuit 52.

At step 113, it is determined whether a count number of a counter MC has reached a numerical value of 800, which corresponds to a time period of 4 ms (4 ms/5 μs=800). At the initial stage, since MC=0, the control proceeds to step 114, in which the count number of the counter MC is incremented by "1". Then, the routine once ends. Thereafter, although the routine is repeatedly executed at regular intervals of 5 μs, the incrementing of the count number of the counter MC is merely carried out until the count number of the counter MC reaches the numerical value of 800 (with F1=1 and F2=1).

At step 113, when it is confirmed that the count number of the counter MC has reached the numerical value of 800, the control proceeds from step 113 to step 115, in which the selection-control signal "ST1" is returned to the low-level, so that the selective and electrical energization of the electric resistance elements $R_{m1}$ to $R_{mn}$ of the thermal head 30M is stopped.

At step 116, the counter MC is reset to "0". Then, at step 117, the flag F1 is made to be "0", and the flag F3 is made to be "1". Thus, the routine once ends.

When the routine is executed after the time of 5 μs has elapsed, the control proceeds to step 102 via step 101 (F1=0 at step 117), in which it is determined whether a third latch pulse of the low-active latch signal "LATCH", indicated by reference LAT3 in the timing chart of FIG. 13, is outputted from the printer control circuit 40 to the latch circuit 52. If the outputting of the third latch pulse "LAT3" is not confirmed, the routine once ends. Thereafter, although the routine is repeatedly executed at regular intervals of 5 μs, there is no progress until the outputting of the third latch pulse "LAT3" is confirmed.

As is apparent from the timing chart of FIG. 13, during the selective and electrical energization of the electric resistance elements $R_{m1}$ to $R_{mn}$ of the thermal head 30M, a first single-line of digital yellow image-pixel signals, indicated by reference Y1(DATA), is inputted to the shift register 50, and these digital yellow image-pixel signals Y1(DATA) are successively shifted to the flip-flops $\mathbf{50}_1$ to $\mathbf{50}_n$ in accordance with the series of clock pulses "CLK", as shown in the timing chart of FIG. 13. Then, the respective digital yellow image-pixel signals Y1(DATA) held by the flip-flops $\mathbf{50}_1$ to $\mathbf{50}_n$ are simultaneously shifted to the latches $\mathbf{52}_1$ to $\mathbf{52}_n$ of the latch circuit 52, and are latched by outputting the third latch pulse "LAT3".

At step 102, when the outputting of the third latch pulse "LAT3" is confirmed, the control proceeds to step 103, in which the flag F1 is made to be "1". Then, the control jumps from step 104 to step 111 (F2=1), and further jumps from step 111 to step 118 (F3=1), in which the selection-control signals "ST1" and "ST2" are made to be high, whereby only the electric resistance elements $R_{y1}$ to $R_{yn}$ of the thermal head 30Y are selectively and electrically energized in the accordance with the magenta image-pixel signals Y1(DATA) held in the latches $\mathbf{52}_1$ to $\mathbf{52}_n$ of the latch circuit 52.

At step 119, it is determined whether a count number of a counter YC has reached a numerical value of 1000, which corresponds to a time period of 5 ms (5 ms/5 μs=1000). At the initial stage, since YC=0, the control proceeds to step 120, in which the count number of the counter YC is incremented by "1". Then, the routine once ends. Thereafter, although the routine is repeatedly executed at regular intervals of 5 $\mu$s, the incrementing of the count number of the counter YC is merely carried out until the count number of the counter YC reaches the numerical value of 1000 (with F1=1, F2=1 and F3=1).

At step 119, when it is confirmed that the count number of the counter YC has reached the numerical value of 1000, the control proceeds from step 119 to step 121, in which the selection-control signals "ST1" and "ST2" are returned to the low-level, so that the selective and electrical energization of the electric resistance elements $R_{y1}$ to $R_{yn}$ of the thermal head 30Y is stopped.

At step 122, the counter YC is reset to "0". Then, at step 123, the flag F1 is made to be "0", the flag F2 is made to be "0", and the flag F3 is made to be "0". Thus, the routine once ends. Thereafter, although the routine is repeatedly executed at regular intervals of 5 $\mu$s, there is no progress until the outputting of the first latch pulse "LAT1" is again confirmed.

As is apparent from the timing chart of FIG. 13, during the selective and electrical energization of the electric resistance elements $R_{y1}$ to $R_{yn}$ of the thermal head 30Y, a second single-line of digital cyan signals, indicated by reference C2(DATA), is inputted to the shift register 50, and these digital cyan image-pixel signals C2(DATA) are successively shifted to the flip-flops $\mathbf{50}_1$ to $\mathbf{50}_n$ in accordance with the series of clock pulses "CLK", as shown in the timing chart of FIG. 13.

On the other hand, as soon as the selective and electrical energization of the electric resistance elements $R_{y1}$ to $R_{yn}$ of the thermal head 30Y is completed (step 121), the motors 48C, 48M and 48Y are driven in accordance with the series of drive pulses outputted from the motor driver circuit 46, such that the image-forming sheet 10 is intermittently fed by a distance corresponding to the single-line of image-dots recorded on the image-forming sheet 10.

After the intermittent movement of the image-forming sheet 10 is completed, once the first latch pulse "LAT1" is again outputted from the printer control circuit 40 to the latch circuit 52, the selective and electrical energization of the electric resistance elements ($R_{c1}$ to $R_{cn}$; $R_{m1}$ to $R_{mn}$; and $R_{y1}$ to $R_{yn}$) are cyclically repeated in accordance with the aforesaid execution of the routine in FIGS. 11 and 12 until a color image is completely recorded on the image-forming sheet 10.

As is apparent from the foregoing, according to the present invention, plural thermal heads (30C, 30M, 30Y) have a common single shift register (50) and a common single latch circuit (52). Accordingly, in comparison to a conventional case where a thermal head driver system is provided for each thermal head, it is possible to reduce a production cost of the thermal head driver system according to the present invention.

In the aforesaid embodiment of the present invention, although the three thermal heads 30C, 30M and 30Y are selectively driven by the combination of the levels of the two selection-control signals "ST1" and "ST2", of course, it is possible to perform a selective driving of two thermal heads by the combination of the levels of the two selection-control signals "ST1" and "ST2". On the other hand, in a case where a combination of levels of three selection-control signals are utilized, it is possible to selectively drive at least seven thermal heads in accordance with at least seven types of digital image-pixel signals. Namely, when n selection-control signals are utilized, it is possible to selectively drive a number of thermal heads, being $(2^n-1)$.

Finally, it will be understood by those skilled in the art that the foregoing description is of preferred embodiments of the system and the apparatus, and that various changes and modifications may be made to the present invention without departing from the spirit and scope thereof.

The present disclosure relates to a subject matter contained in Japanese Patent Application No. 10-106137 (filed on Apr. 16, 1998) which is expressly incorporated herein, by reference, in its entirety.

What is claimed is:

1. A thermal head driver system that cyclically and independently drives each of at least two thermal heads having each a plurality of electric resistance elements, said system comprising:

a storage system that cyclically stores an image information data, said image information data cyclically being each of at least two types of image information data, respectively corresponding to said at least two thermal heads; and a selector system that cyclically and correspondingly selects which thermal head should be driven in accordance with said cyclical storage of said at least two types of image information data in said storage system, such that said electric resistance elements of said thermal head, selected by said selector system, are selectively and electrically energized in accordance with a corresponding type of image information data cyclically stored in said storage system.

2. A thermal head driver system as set forth in claim 1, further comprising a determiner system that determines a time period over which said thermal head, selected by said selector system, is driven.

3. A thermal head driver system as set forth in claim 1, wherein said selector system comprises a signal generator that generates at least two selection-control signals, each of which changes between a first level and a second level, and said cyclical selection of said driving of said at least two thermal heads is performed in accordance with a combination of said levels of said at least two selection-control signals.

4. A thermal head driver system as set forth in claim 3, wherein one of said thermal heads is correspondingly selected to be driven by said selector system when at least one of said at least two selection-control signals is changed from said first level to said second level.

5. A thermal head driver system as set forth in claim 4, wherein none of said thermal heads are selected to be driven by said selector system when said at least two selection-control signals are kept at said first level.

6. The thermal head driver system as set forth in claim 1, wherein said storage system is a single latch circuit.

7. An image-forming apparatus that forms an image on an image-forming substrate that includes a base member and a layer of micro-capsules, coated over said base member, containing a first type of microcapsule filled with a first monochromatic dye, and a second type of microcapsule filled with a second monochromatic dye, said first type of microcapsule exhibiting a first pressure/temperature characteristic such that, when said first type of microcapsule is squashed under a first pressure at a first temperature, said first type of microcapsule breaks discharging said first dye, said second type of microcapsule exhibiting a second pressure/temperature characteristic such that, when said second type of microcapsule is squashed under a second pressure at a second temperature, the first pressure/temperature characteristic and the second pressure/temperature characteristic being different from each other, said second type of microcapsule breaks discharging said second dye, said apparatus comprising:

a first pressure applicator that locally exerts said first pressure on said layer of microcapsules;

a second pressure applicator that locally exerts said second pressure on said layer of microcapsules, said first pressure applicator and said second pressure applicator being different from each other;

a first thermal head that is driven such that a first localized area of said layer of microcapsules, on which said first pressure is exerted by said first pressure applicator, is heated to said first temperature in accordance with a first image-information data, such that said first type of microcapsule in said first localized area is selectively broken;

a second thermal head that is driven such that a second localized area of said layer of microcapsules, on which said second pressure is exerted by said second pressure applicator, is heated to said second temperature in accordance with a second image-information data, such that said second type of microcapsule in said second localized area is selectively squashed; and a thermal head driver system that cyclically and independently controls said driving of said first and second thermal heads, wherein said thermal head driver system comprises:

a storage system that cyclically stores an image information data, said image information data cyclically being each of said first and second information data; and a selector system that cyclically and correspondingly selects which thermal head should be driven in accordance with said cyclical storage of said first and second image information data in said storage system, such that electric resistance elements of said thermal head selected by said selector system are selectively and electrically energized in accordance with said image information data stored in said storage system.

8. An image-forming apparatus as set forth in claim 7, wherein said thermal head driver system further comprises a determiner system that determines a time period over which said thermal head, selected by said selector system, is driven.

9. An image-forming apparatus as set forth in claim 7, wherein said selector system comprises a signal generator that generates two selection-control signals, each of which changes between a first level and a second level, the first level and the second level being different from each other, and said cyclical selection of said driving of said first and second thermal heads is performed in accordance with a combination of said levels of said selection-control signals.

10. An image-forming apparatus as set forth in claim 9, wherein one of said first and second thermal heads is correspondingly selected to be driven by said selector system when at least one of said two selection-control signals is changed from said first level to said second level.

11. An image-forming apparatus as set forth in claim 9, wherein none of said first and second thermal heads are selected to be driven by said selector system when said two selection-control signals are kept at said first level.

12. An image-forming apparatus as set forth in claim 7, wherein said layer of microcapsules further contains a third type of microcapsule filled with a third monochromatic dye, said third type of microcapsule exhibiting a third pressure/temperature characteristic different from the first and the second pressure/temperature characteristics such that, when said third type of microcapsule is squashed under a third pressure at a third temperature, said third type of microcapsule breaks discharging said third dye, said apparatus further comprising:

a third pressure applicator that locally exerts said third pressure on said layer of microcapsules, said third pressure applicator being different from said first and said second pressure applicators; and a third thermal head that is driven such that a third localized area of said layer of microcapsules, on which said third pressure is exerted by said third pressure applicator, is heated to said third temperature in accordance with a third image-information data, such that said third type of microcapsule in said third localized area is selectively squashed, said thermal head driver system cyclically and independently controlling said driving of said first, second and third thermal heads, said storage system cyclically storing an image information data, said image information data cyclically being each of said first, second and third image information data, and said selector system cyclically and correspondingly selecting which thermal head should be driven in accordance with said cyclical storage of said first, second and third image information data in said storage system.

13. A thermal head driver system as set forth in claim 12, further comprising a determiner system that determines a time period over which said thermal head, selected by said selector system, is driven.

14. A thermal head driver system as set forth in claim 12, wherein said selector system comprises a signal generator that generates two selection-control signals, each of which changes between a first level and a second level, the first level and the second level being different from each other, and said cyclical selection of said driving of said first, second and third thermal heads is performed in accordance with a combination of said levels of said selection-control signals.

15. A thermal head driver system as set forth in claim 14, wherein one of said first, second and third thermal heads is correspondingly selected to be driven by said selector system when at least one of said two selection-control signals is changed from said first level to said second level.

16. A thermal head driver system as set forth in claim 14, wherein none of said first, second and third thermal heads is selected to be driven by said selector system when all of said two selection-control signals are kept at said first level.

17. The image-forming apparatus as set forth in claim 7, wherein said storage system is a single latch circuit.

* * * * *